US008152650B1

(12) United States Patent
Brandt

(10) Patent No.: US 8,152,650 B1
(45) Date of Patent: Apr. 10, 2012

(54) GOLF SWING PRACTICE DEVICE FOR ENGAGING A GOLFER'S KNEE OR CALF MUSCLE AND PREVENTING BODY SWAY DURING A GOLF CLUB BACK SWING

(76) Inventor: Gary Brandt, Arvada, CO (US)

( * ) Notice: Subject to any disclaimer, the term of this patent is extended or adjusted under 35 U.S.C. 154(b) by 0 days.

(21) Appl. No.: 13/066,094

(22) Filed: Apr. 7, 2011

Related U.S. Application Data

(60) Provisional application No. 61/343,356, filed on Apr. 28, 2010.

(51) Int. Cl.
*A63B 69/36* (2006.01)

(52) U.S. Cl. ..... 473/266; 473/271

(58) Field of Classification Search ..... 473/207, 473/215, 217, 218, 266, 270–273, 274–277
See application file for complete search history.

(56) References Cited

U.S. PATENT DOCUMENTS 4,651,994 A * 3/1987 Lee ..... 473/271
4,659,084 A * 4/1987 Vuick ..... 473/264
5,591,090 A * 1/1997 Kauffman, Jr. ..... 473/271
6,575,844 B1 * 6/2003 Gray ..... 473/277
7,517,287 B1 * 4/2009 Dovel et al. ..... 473/271
7,758,443 B1 * 7/2010 Ford ..... 473/266
7,980,958 B1 * 7/2011 Ford ..... 473/266
2006/0122003 A1 * 6/2006 Kim ..... 473/271

* cited by examiner

*Primary Examiner* — Nini Legesse
(74) *Attorney, Agent, or Firm* — Edwin H. Crabtree; Ramon L. Pizarro

(57) ABSTRACT

An adjustable golf swing practice device adapted for engaging a knee or calf muscle of a back leg of a golfer and preventing body sway during a golf club back swing. The practice device includes an adjustable leg brace for engaging the outside of the knee or calf muscle to help encourage and maintain knee flex and prevent the straightening or locking of the back leg during a club back swing. The leg brace is attached to an adjustable leg brace pole having a telescoping rod and an outer tube for adjusting the length of the pole for different heights of golfers. The outer tube is pivotally mounted on a leg brace pole housing with housing base. The housing base includes a horizontal shoe extension, which is used for receiving the golfer's shoe thereon and holding the practice device in place during practice.

13 Claims, 2 Drawing Sheets

GOLF SWING PRACTICE DEVICE FOR ENGAGING A GOLFER'S KNEE OR CALF MUSCLE AND PREVENTING BODY SWAY DURING A GOLF CLUB BACK SWING

This non-provisional patent application claims the benefit of an earlier filing date of a provisional patent application filed on Apr. 28, 2010, Ser. No. 61/343,356, by the subject inventor, and having a title of "Golf Swing Practice Device".

BACKGROUND OF THE INVENTION (a) Field of the Invention

This invention relates to a golf training device for improving a golfer's swing and more particularly, but not by way of limitation, to a golf swing practice device for standing on and engaging the outside of a golfer's knee or calf muscle. The practice device helps prevent sway of the body and helps maintain knee flex during a golf club's back swing thereby helping to increase power and center of balance when hitting a golf ball during the club's follow through.

(b) Discussion of Prior Art

Heretofore, the have been any number of different types of golf swing training devices for helping improve a golfer's back swing and follow through. None of these training and practice devices provide the unique structure, function and advantages of the subject invention as described herein.

SUMMARY OF THE INVENTION

In view of the foregoing, it is a primary objective of the subject invention to provide an adjustable golf swing practice device for both right and left handed golfers. A portion of the device is adapted for standing on by the golfer's shoe to hold it in place. The device includes an adjustable leg brace for engaging the outside of the back leg at the knee or calf muscle during a golf club back swing.

A key feature of the invention is the device prevents the back leg from straightening out or the locking of the knee during the club back swing. By keeping the back leg flexed and stationary, the golfer can build a powerful body coil plus maintain a center of balance and position for consistent shot making. Using the device, the golfer can feel what its like to shift his or her weight to the inside of the back foot. Then, the golfer can push off correctly from the back foot thus shifting the weight properly to the front leg. Also, as the golfer becomes comfortable in using the device, only slight pressure on contact can be used rather than using it as a support brace.

Still another object of the invention is the practice device is lightweight, easy to adjust for different heights of golfers, easy to adjust for a right or left handed golfer, and can be quickly repositioned by moving it with a shoe or a knee and after taking a grass divot during the practice of hitting golf irons. Also, the device can be turned around and used to teach what it feels like to transfer weight to a front shoe and post up on the front leg. After the golfer hits the ball, he or she can simply finish standing up on the toe of the back foot when a proper weight shift has been made.

These and other objects of the present invention will become apparent to those familiar with various types of golf training devices used to improve a golfer's swing when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the subject golf training device, and in which.

DESCRIPTION OF THE PREFERRED EMBODIMENTS

Figure 1:
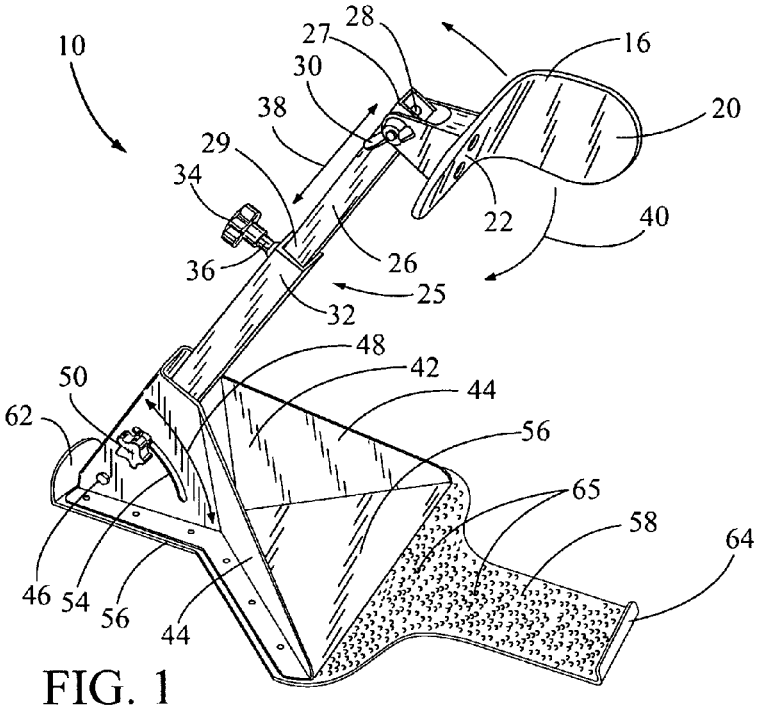
FIG. 1 illustrates a perspective view of the subject golf swing practice device.
Figure 3:
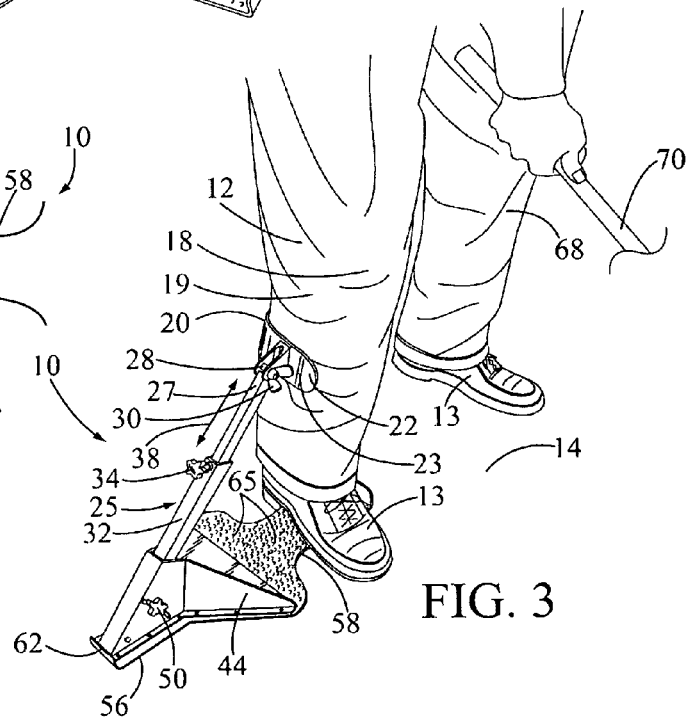
FIG. 3 is perspective view of the golf swing practice device and engaging a calf muscle of the right leg of a right handed golfer.
Figure 4:
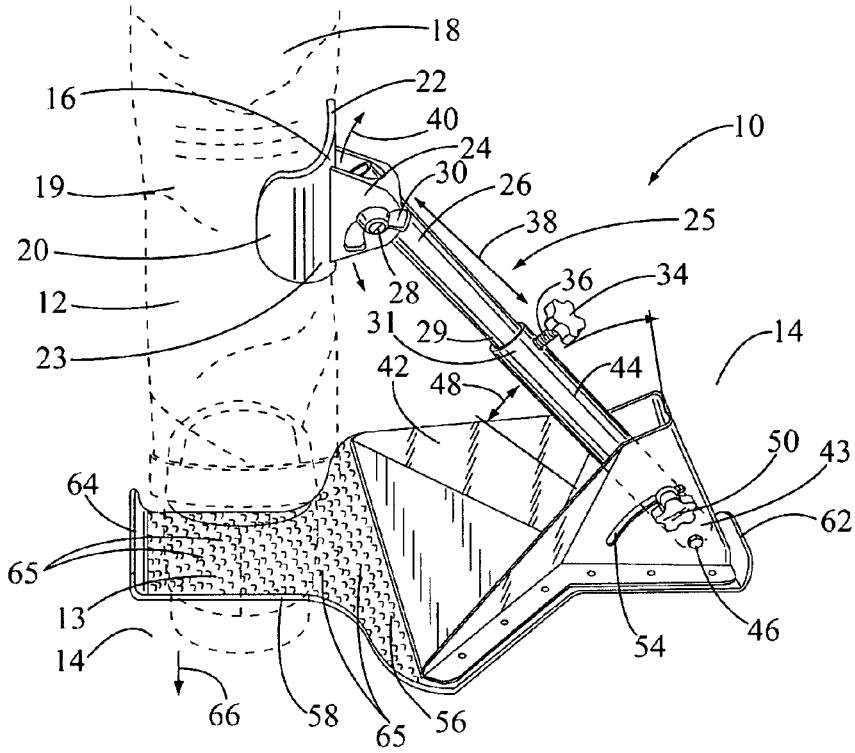
FIG. 4 is rear perspective view of the golf swing practice device engaging the calf muscle of the right leg of the golfer.
Figure 5:
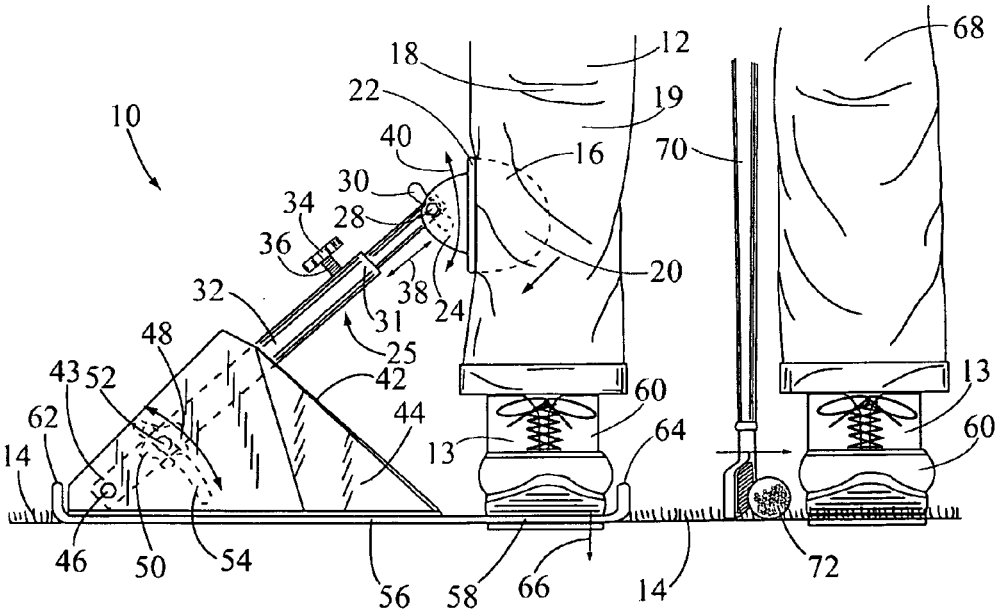
FIG. 5 is a front view of the golf swing practice device illustrating both of the golfers legs and a portion of a golf club addressing a golf ball.

In FIG. 1, a perspective view of the subject adjustable golf swing practice device for both right and left handed golfers is shown and having general reference numeral 10. The practice device 10 is adapted for engaging a back leg 12 of a golfer. The back leg 12 is shown in FIGS. 3, 4 and 5 and in this example, it's the right leg of a right handed golfer. Obviously, the back leg 12 would be the left leg of a left handed golfer. Also shown in FIGS. 3, 4 and 5 is a shoe 13 of the golfer used to hold the device 10 in place on a ground surface 14.

The practice device 10 includes an adjustable leg brace 16 for engaging the outside of the leg 12 at the knee 18 or calf muscle 19 to help encourage and maintain knee flex and prevent the straightening or locking of the back leg during a club back swing. The knee 18 and calf muscle 19 are shown in FIGS. 3, 4 and 5. The leg brace 16 has an "L" shaped configuration with a back portion 20 for engaging a back of the knee or calf muscle to help prevent straightening or locking of the leg during the back swing. A front side 22 of the leg brace 16 is used to engage the outside of the knee 18 or calf muscle 19 to help prevent body sway during the back swing.

A back side 23 of the side portion 22 of the leg brace 16 includes a swivel mounting base 24 for pivotal attachment to an adjustable leg brace pole. The leg brace pole is shown in the drawings having a general reference numeral 25. The leg brace pole 25 includes a telescoping rod 26. The rod 26 includes an upper end 27 attached to the swivel mounting base 24 and tightened thereon using a threaded screw 28 with a wing nut 30.

The leg brace pole 25 also includes an outer tube 32. A lower end 29 of the rod 26 is received in an upper end 31 of the outer tube 32 and secured thereon using a height adjustment knob 34 with a threaded screw 36. By loosening the knob 34, the rod 26 can be adjusted outwardly or inwardly, as indicated by arrow 38, for different heights of golfers. Also, the rod 26 can be rotated 180 degrees, as indicated by arrow 40 shown in FIG. 4, on the outer tube 32 for converting the device 10 from use by a right handed golfer to a left handed golfer.

A lower end 43, shown in dashed lines in FIGS. 4 and 5, of the outer tube 32 is received inside an open front 42 of a pyramid-shaped, leg brace pole housing 44. The lower end 43 of the tube 32 is attached to a pivot pin 46 near the bottom of the housing 44. The tube 32 is raised and lowered, as indicated by arrow 48, using another height adjustment knob 50 with threaded screw 52 received through a semi-circular channel 54 in one side of the housing 44. In this drawing, the outer tube 32 is shown in a raised position inside the housing. By loosening the knob 50, the tube 32 can be lowered on top of a horizontal housing base 56, when storing the practice device 10.

The housing base 56 includes a horizontal shoe extension 58, which is used for receiving the golfer's shoe 13 thereon and holding the practice device 10 in place during practice. One end of the base 56 includes an upwardly extending base lip 62. The shoe extension 58 also includes an upwardly extending, shoe extension lip 64. The two lips 62 and 64 are used for ease in moving the device 10 to the left or right, using the shoe 13 or the knee 18 to align with ball position and after taking a divot, when practicing with golf irons.

Figure 2:
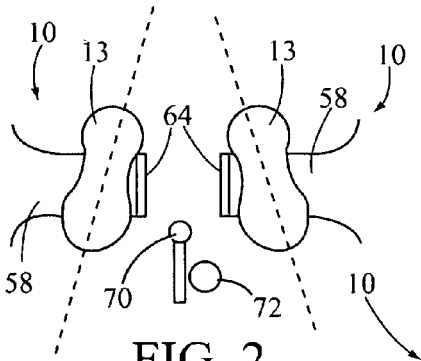
FIG. 2 illustrates a top view of a typical golfer's stance having a "V" shape configuration for stability and using a pair of the subject golf swing practice devices.

In FIG. 2, a top view of a typical golfer's stance having a "V" shape configuration, shown in dashed lines, for stability. In this illustration, the golfer's shoes 13 are shown placed on top of the leg extensions 58 of a pair of the subject golf swing practice devices 10.

In FIG. 3, a perspective view of the golf swing practice device 10 and the golfer's back leg 12 and a front leg 68 are shown with the legs in a "V" shaped stance. In this drawing, the front and side portions 20 and 22 of the leg brace 16 are illustrated engaging the calf muscle 19 of the back leg 12 or right leg of the right handed golfer.

In FIG. 4, a rear perspective view of the golf swing practice device 10 is shown and engaging the calf muscle 19 of the back leg 12, shown in dashed lines. This drawing is similar to the perspective view of the practice device shown in FIG. 1.

In FIG. 5, a front view of the practice device 10 is illustrated with the leg brace 16 adjusted for engaging the rear and outside of the calf muscle 19. In this drawing, an arrow 66 is shown to depict the proper placement of the weight on inside of the shoe 13 for increased golf club stroke power during the follow through, when striking the golf ball.

Also shown in this drawing is the golfer's left leg 68, the shoe 13, a golf iron 70 and a golf ball 72 resting on the ground surface 14. It should be mentioned that while only one of the subject golf swing practice devices 10 is discussed above, an additional device can be used equally well for engaging the opposite knee or calf muscle of the golfer and giving him or her the feeling of what it's like to shift the weight forward on the down swing and post up on the front leg 68.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed are defined as follows:

1. A golf swing practice device for engaging a portion of a golfer's knee or calf muscle and for maintaining knee flex and preventing body sway during a golf club back swing, the practice device comprising:

an adjustable leg brace, the brace adapted for engaging an outside of the knee or the calf muscle;

a swivel mounting base mounted on a back side of the leg brace;

an adjustable leg brace pole, the pole having an upper end and a lower end, the upper end of the pole attached to the swivel mounting base; and a leg brace pole housing mounted on top of a horizontal housing base, the lower end of the pole pivotally attached to the housing for raising and lowering the leg brace pole, the housing base having an outwardly extending horizontal shoe extension adapted for receiving a golfer's shoe thereon during the use of the practice device the shoe extension includes an upwardly extending shoe extension lip, the shoe extension lip used for moving the practice device on the ground surface.

2. The practice device as described in claim 1 wherein the housing base includes an upwardly extending base lip, the base lip used for moving the practice device on a ground surface.

3. The practice device as described in claim 1 wherein the leg brace has an "L" shaped configuration with a back portion adapted for engaging a back of the knee or calf muscle and a front side adapted for engaging the outside of the knee or calf muscle.

4. The practice device as described in claim 1 wherein the adjustable leg brace pole includes a telescoping rod and outer tube, the rod having an upper end and a lower end, the upper end of the rod attached to the leg brace, the outer tube having an upper end and a lower end, the lower end of the rod slidably received in the upper end of the outer tube, the lower end of the outer tube pivotally attached to the housing for raising and lowering the leg brace pole.

5. A golf swing practice device for engaging a portion of a golfer's knee or calf muscle and for maintaining knee flex and preventing body sway during a golf club back swing, the practice device comprising:

an adjustable leg brace, the brace adapted for engaging an outside of the knee or calf muscle, the leg brace having an "L" shaped configuration with a back portion adapted for engaging a back of the knee or calf muscle and a front side adapted for engaging the outside of the knee or calf muscle;

a swivel mounting base mounted on a back side of the leg brace;

an adjustable leg brace pole, the pole including a telescoping rod having an upper end and a lower end, the upper end of the rod pivotally attached to the leg brace, the pole including an outer tube having an upper end and a lower end, the lower end of the rod slidably received in the upper end of the outer tube; and a leg brace pole housing mounted on top of a horizontal housing base, the lower end of the outer tube pivotally attached to the housing for raising and lowering the leg brace pole thereon, the housing base having an outwardly extending horizontal shoe extension adapted for receiving a golfer's shoe thereon during the use of the practice device, the housing base includes an upwardly extending base lip, the base lip used for moving the practice device on a ground surface.

6. The practice device as described in claim 5 wherein the shoe extension includes an upwardly extending shoe extension lip, the shoe extension lip used for moving the practice device on a ground surface.

7. The practice device as described in claim 5 wherein the rod is attached to the swivel mounting base using a threaded screw and wing nut.

8. The practice device as described in claim 5 wherein the lower end of the rod is secured to the upper end of the outer tube using a height adjustment knob with a threaded screw.

9. The practice device as described in claim 5 wherein the outer tube is raised and lowered on the housing a threaded screw attached to the outer tube and received through a semi-circular channel in one side of the housing.

10. A golf swing practice device for engaging a portion of a golfer's knee or calf muscle and for maintaining knee flex and preventing body sway during a golf club back swing, the practice device comprising:

an adjustable leg brace, the brace adapted for engaging an outside of the knee or calf muscle, the leg brace having an "L" shaped configuration with a back portion adapted for engaging a back of the knee or calf muscle and a front side adapted for engaging the outside of the knee or calf muscle;

a swivel mounting base mounted on a back side of the leg brace;

an adjustable leg brace pole, the pole including a telescoping rod having an upper end and a lower end, the upper end of the rod pivotally attached to the leg brace using a threaded screw and wing nut, the pole including an outer tube having an upper end and a lower end, the lower end of the rod slidably received in the upper end of the outer tube and attached thereto using a threaded screw and height adjustment knob; and an open front, pyramid-shaped, leg brace pole housing mounted on top of a horizontal housing base, the lower end of the outer tube pivotally attached to the housing for raising and lowering the leg brace pole thereon, the housing having an outwardly extending horizontal shoe extension adapted for receiving a golfer's shoe thereon during the use of the practice device.

11. The practice device as described in claim 10 wherein the housing base includes an upwardly extending base lip, the base lip used for moving the practice device on a ground surface.

12. The practice device as described in claim 10 wherein the shoe extension includes an upwardly extending shoe extension lip, the shoe extension lip used for moving the practice device on a ground surface.

13. The practice device as described in claim 10 wherein the outer tube is raised and lowered on the housing a threaded screw attached to the outer tube and received through a semi-circular channel in one side of the housing.

* * * * *